US006707428B2

(12) United States Patent
Gram

(10) Patent No.: US 6,707,428 B2
(45) Date of Patent: Mar. 16, 2004

(54) ANTENNA

(75) Inventor: Hans Erik Gram, Bagsvaerd (DK)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/153,867

(22) Filed: May 24, 2002

(65) Prior Publication Data

US 2002/0175866 A1 Nov. 28, 2002

Related U.S. Application Data

(60) Provisional application No. 60/293,180, filed on May 25, 2001.

(51) Int. Cl.[7] ..... H01Q 1/38
(52) U.S. Cl. ..... 343/700 MS; 343/833
(58) Field of Search ..... 343/700 MS, 702, 343/833, 834, 846, 848, 845

(56) References Cited

U.S. PATENT DOCUMENTS 5,926,139 A 7/1999 Korisch ..... 343/702
6,281,848 B1 * 8/2001 Nagumo et al. ..... 343/700 MS
6,456,249 B1 * 9/2002 Johnson et al. ..... 343/702

FOREIGN PATENT DOCUMENTS

| | | |
|---|---|---|
| EP | 1 168 491 A1 | 1/2002 |
| JP | 06 069715 A | 3/1994 |
| JP | 07 131234 A | 5/1995 |
| WO | WO 01/33665 A1 | 5/2001 |

* cited by examiner

*Primary Examiner*—James Clinger
(74) *Attorney, Agent, or Firm*—Antonelli, Terry, Stout & Kraus, LLP

(57) ABSTRACT

A broadband antenna comprises a driven element and a parasitic element resonant at different frequencies so that the antenna had a bandwidth encompassing both resonant frequencies. A further driven element, resonant at a third frequency, may be added so that the antenna is also usable in a different separate band.

6 Claims, 3 Drawing Sheets

ANTENNA

Figure 1:
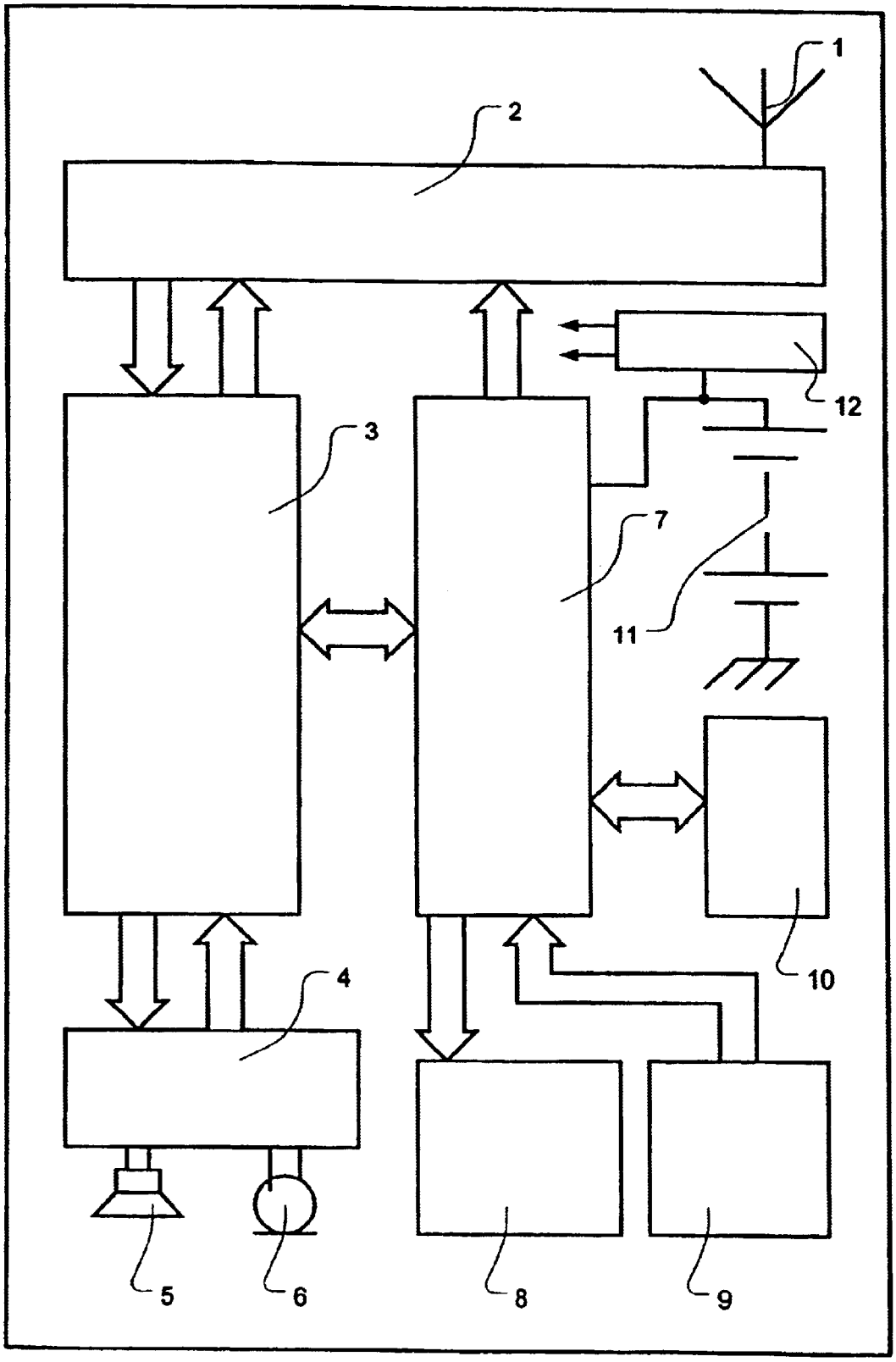

This application claims priority of U.S. Provisional Patent Application 60/293,180 filed May 25, 2001.

BACKGROUND OF THE INVENTION

1. Field of the Invention

The present invention relates to an antenna.

2. Description of the Prior Art

GSM mobile phone services have been allocated three bands. In most countries 900 MHz (880–960 MHz) and 1880 MHz (1710–1880 MHz) bands are used. However, in the United States, GSM services have been allocated a 1900 MHz (1850–1990 MHz) band. A broadband antenna is desirable so that mobile phones that can operated in both the 1800 MHz and 1900 MHz bands, which overlap. However, conventional broadband antennas are too large to be incorporated into the small form of modern mobile phones.

One solution to this problem, that has been tried, is the use of two elements both tuned to the middle of the combined 1800 MHz/1900 MHz band. This has to effect of producing a wider, double peak or flat-top frequency characteristic.

SUMMARY OF THE INVENTION

According to the present invention, there is provided an antenna comprising a driven element, resonant at a first frequency and a parasitic element, wherein the parasitic element is resonant at a second different frequency and the resonant frequencies are such that the antenna has an operational band of usable frequencies encompassing the first and second frequencies.

It has been found that improvements in return loss, over the prior art where both elements resonate at the same frequency, can be achieved.

Preferably, both of the elements are connected to ground at one end.

A further parasitic element may be included which is resonant at a third frequency, substantially lower than the first and second frequencies, and has an operational band that does not overlap that of the combination of the first and second elements. The further parasitic element may meander and be connected to ground at one end.

Preferably, the elements comprise foil patterns of a substantially planar substrate. The driven element and the further parasitic element preferably comprises foil patterns on a major face of the substrate and the other parasitic element comprising a foil pattern along an edge of the substrate. More preferably, a common ground terminal for connecting the elements to an external ground and a single feed terminal for connection to an external signal feed. The terminals may be located at the floor of a peripherally located stepped portion of the substrate.

According to the present invention, there is also provided an antenna comprising a substantially planar substrate, a first driven element, resonant at a first frequency, a second driven element, resonant at a second, lower frequency, a parasitic element associated with the first driven element, a common ground terminal for connecting all of the elements to an external ground and a single feed terminal for connection to an external signal feed, wherein the elements and terminals comprise a conductive pattern on the substrate.

The second driven element may meander.

Preferably, the driven elements comprise foil patterns on a major face of the substrate and the parasitic element comprises a foil pattern along an edge of the substrate.

Preferably, the substrate includes a peripherally located stepped portion and the terminals are located at the floor of the stepped portion.

An antenna according to the present invention may be mounted within the casing of a mobile phone.

BRIEF DESCRIPTION OF THE INVENTION

Figure 2:
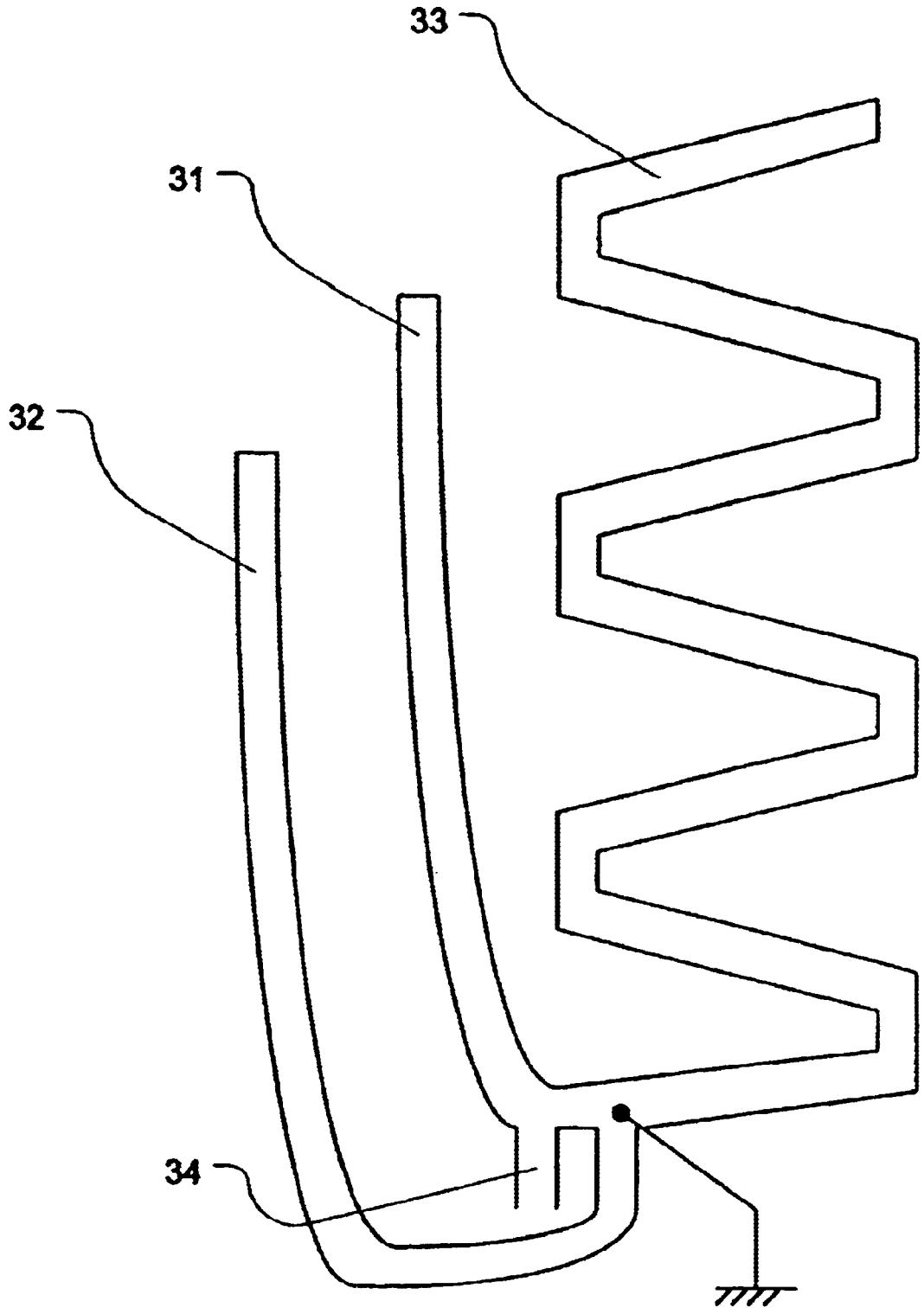
Figure 3:
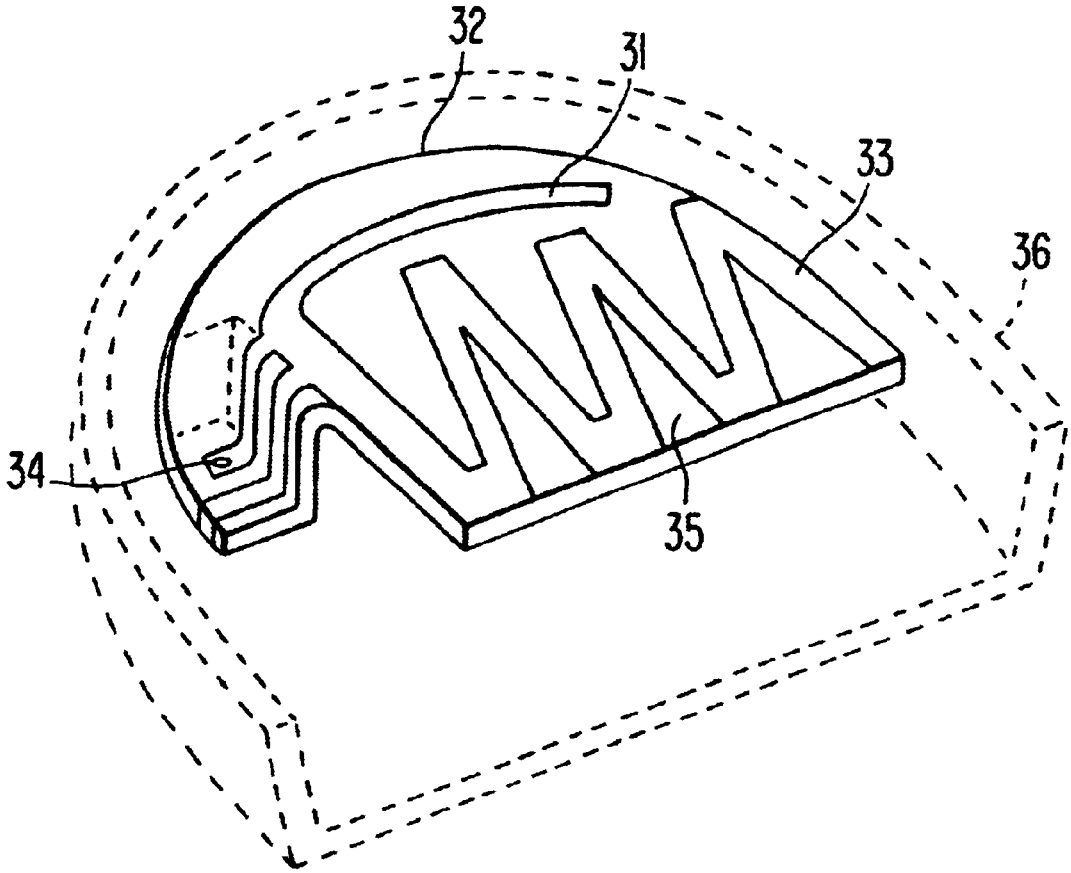

An embodiment of the present will now be described, by way of example, with reference to the accompanying drawings, in which:

FIG. 1 is a block diagram of a mobile phone according to the present invention, FIG. 2 is a schematic diagram of an antenna according to the present invention; and FIG. 3 shows the physical form of the antenna of FIG. 2.

Referring to FIG. 1, a mobile telephone comprises an antenna 1, an rf subsystem 2, a baseband DSP (digital signal processing) subsystem 3, an analog audio subsystem 4, a loudspeaker 5, a microphone 6, a controller 7, a liquid crystal display 8, a keypad 9, memory 10, a battery 11 and a power supply circuit 12.

The rf subsystem 2 contains if and rf circuits of the mobile telephone's transmitter and receiver and a frequency synthesizer for tuning the mobile telephone's transmitter and receiver. The antenna 1~is coupled to the rf subsystem 2 for the reception and transmission of radio waves.

The baseband DSP subsystem 3 is coupled to the rf subsystem 2 to receive baseband signals therefrom and for sending baseband modulation signals thereto. The baseband DSP subsystems 3 includes codec functions which are well-known in the art.

The analog audio subsystem 4 is coupled to the baseband DSP subsystem 3 and receives demodulated audio therefrom. The analog audio subsystem 4 amplifies the demodulated audio and applies it to the loudspeaker 5. Acoustic signals, detected by the microphone 6, are preamplified by the analog audio subsystem 4 and sent to the baseband DSP subsystem 4 for coding.

The controller 7 controls the operation of the mobile telephone. It is coupled to the rf subsystem 2 for supplying tuning instructions to the frequency synthesizer and to the basebaud DSP subsystem for supplying control data and management data for transmission. The controller 7 operates according to a program stored in the memory 10. The memory 10 is shown separately from the controller 7. However, it may be integrated with the controller 7. A timer for triggering interrupts is also provided by the controller 7.

The display device 8 is connected to the controller 7 for receiving control data and the keypad 9 is connected to the controller 7 for supplying user input data signals thereto. Amongst other functions, the display device displays the estimated existing life of the battery 11.

The battery 11 is connected to the power supply circuit 12 which provides regulated power at the various voltages used by the components of the mobile telephone. The positive terminal of the battery 11 is connected to an analog-to-digital converter (ADC) input of the controller 7.

Referring to FIG. 2, the antenna 1 comprises a first driven element 31, a parasitic element 32 and a second driven element 33. The first driven element 31 is resonant at approximately 1920 MHz, the parasitic element 32 is resonant at approximately 1785 MHz and the second driven element 33 is resonant at approximately 920 MHz.

The second driven element 33 is in the form of a meander to reduce its overall length so that it can be accommodated within the casing of the mobile phone.

The feed point 34 is connected to the first driven element so that a usable match to 50Ω is obtained over the working frequency range of the antenna.

When power is fed to the antenna in the 1800 MHz and 1900 MHz bands, power is distributed between the first driven element 31 and the parasitic element 32. At the lower end of the frequency range of these bands, the parasitic element 32 is the main radiating element. However, at the frequency of the input signal is increased, the first driven element 31 becomes the dominant radiator.

When power is fed to the antenna in the 900 MHz band, the second driven element 33 becomes the radiating element.

It will be understood that a reverse process takes place for the reception of signals using the antenna 1 and that, consequently, the terms "driven element" and "feed" are to be construed to include the reciprocal features of a receiving antenna.

Referring to FIG. 3, the first and second driven elements 31, 33 comprise foil patterns on a surface of a low loss substrate 35. The parasitic element 32 comprises a foil strip along an edge of the substrate 35. The substrate 35 is configured for being installed within the upper part of the casing 36 of the mobile phone. A small peripheral portion of the substrate is stepped and the feed and ground terminals 34, 38 of the antenna are located at the floor 37 of the stepped portion. The single ground terminal 38 for all of the elements 31, 32, 33 means that only two soldering operations are involved in the installation of the antenna, one for the feed connection and one for the ground connection.

It will be appreciated that many modifications may be made to the above-described embodiment, particularly in the physical form of the elements and the number thereof.

What is claimed is:

1. An antenna comprising:

a substantially planar substrate;

a first driven element, resonant at a first frequency, a second driven element, resonant at a second, lower frequency, and a parasitic element associated with the first driven element, a common ground terminal for connecting all of the elements to an external ground and a single feed terminal for connection to an external signal feed, wherein the elements and terminals comprise a conductive pattern on the substrate, the substrate includes a peripherally located stepped portion having a floor and the terminals are located at the floor of the stepped portion.

2. An antenna according to claim 1, wherein the second driven element meanders.

3. An antenna according to claim 1, wherein the driven elements comprise foil patterns on a major face of the substrate and the parasitic element comprises a foil pattern along an edge of the substrate.

4. A mobile phone including a casing and an antenna mounted within the casing, the antenna comprising a substantially planar substrate, a first driven element, resonant at a first frequency, a second driven element, resonant at a second, lower frequency, and a parasitic element associated with the first driven element, a common ground terminal for connecting all of the elements to an external ground, and a single feed terminal for connection to an external signal feed, wherein the elements and terminals comprise a conductive pattern on the substrate, the substrate includes a peripherally located stepped portion having a floor and the terminals are located at the floor of the stepped portion.

5. A mobile phone according to claim 4, wherein the second driven element meanders.

6. A mobile phone according to claim 4, wherein the driven elements comprise foil patterns on a major face of the substrate and the parasitic element comprises a foil pattern along an edge of the substrate.

* * * * *